US009399997B2

(12) United States Patent
Wu et al.

(10) Patent No.: US 9,399,997 B2
(45) Date of Patent: Jul. 26, 2016

(54) METHOD FOR DETECTING HEAT-DISSIPATING AIR FLOW AND ELECTRONIC DEVICE USING THE SAME

(71) Applicant: Wistron Corporation, New Taipei (TW)

(72) Inventors: Ming-Hsiu Wu, New Taipei (TW); Yi-Hung Hsu, New Taipei (TW)

(73) Assignee: Wistron Corporation, New Taipei (TW)

( * ) Notice: Subject to any disclaimer, the term of this patent is extended or adjusted under 35 U.S.C. 154(b) by 479 days.

(21) Appl. No.: 14/079,322

(22) Filed: Nov. 13, 2013

(65) Prior Publication Data

US 2014/0169936 A1 Jun. 19, 2014

(30) Foreign Application Priority Data

Dec. 14, 2012 (TW) ..... 101147512 A

(51) Int. Cl.
*F04D 27/00* (2006.01)
*F04D 29/58* (2006.01)

(52) U.S. Cl.
CPC ..... *F04D 27/001* (2013.01); *F04D 29/58* (2013.01)

(58) Field of Classification Search
CPC ..... F04D 27/001; F04D 29/58
See application file for complete search history.

(56) References Cited

U.S. PATENT DOCUMENTS 6,414,843 B1 * 7/2002 Takeda ..... G06F 1/206 165/121
6,592,449 B2 * 7/2003 Cipolla ..... G06F 9/52 236/49.1
7,708,056 B2 * 5/2010 Shen ..... F04D 27/004 165/244
2005/0030171 A1 * 2/2005 Liu ..... G06F 1/206 340/500
2007/0156292 A1 * 7/2007 Frankel ..... G05D 23/1917 700/300
2011/0228471 A1 * 9/2011 Humphrey ..... F04D 27/004 361/679.48
2014/0086746 A1 * 3/2014 Tian ..... F04D 27/004 416/35
2014/0161609 A1 * 6/2014 Wei ..... F04D 27/004 416/1

FOREIGN PATENT DOCUMENTS

| | | | |
|---|---|---|---|
| CN | 2407386 | Y | 11/2000 |
| CN | 2718781 | Y | 8/2005 |
| CN | 101908013 | A | 12/2010 |
| JP | 2006-52724 | A | 2/2006 |
| KR | 2020100000629 | U | 1/2010 |
| TW | 201128075 | A1 | 8/2011 |

* cited by examiner

*Primary Examiner* — Igor Kershteyn
(74) *Attorney, Agent, or Firm* — Muncy, Geissler, Olds & Lowe, P.C.

(57) ABSTRACT

A method for detecting heat-dissipating air flow is disclosed. The method includes the following steps: detecting whether a reset command is input; if the reset command is input, resetting a wind pressure standard value according to the reset command; if the reset command is not input, controlling a fan to operate at full speed according to a start signal; detecting the wind pressure of a heat-dissipating air flow after controlling the fan to operate at full speed to acquire a wind pressure value; determining whether the wind pressure value is equal to the wind pressure standard value; and generating a warning signal if the wind pressure value is not equal to the wind pressure standard value.

8 Claims, 3 Drawing Sheets

METHOD FOR DETECTING HEAT-DISSIPATING AIR FLOW AND ELECTRONIC DEVICE USING THE SAME

FIELD

The present invention relates to a method for detecting a heat-dissipating air flow. More specifically, the present invention relates to a method for detecting a heat-dissipating air flow that determines whether the heat-dissipating air flow is sufficient by the method of a pressure sensor detecting the wind pressure of the heat-dissipating air flow, and thus further determines whether the fan or the air-in hole is in an abnormal state; the method may also readjust the wind pressure standard value according to different usage environments.

BACKGROUND

Due to the fast development of information technology, the operation clock speed of the CPU in computer systems (such as laptops, desktop computers or servers) has been increased greatly, and chips or devices having strong functions or faster transition rates are also developed one after another; these devices are necessary devices in modern computer systems today.

However, high-speed calculations generate heat in the devices, and the heat in these devices must be dissipated. The heat-dissipating systems in present-day computer systems mainly use a fan to conduct external air into the devices so as to cool the heated devices or to exhaust heated air through heat dissipation holes. These heat-dissipating methods generate air convection through fans and heat dissipation holes disposed on the housing in order to accomplish the goal of heat dissipation. If the fan breaks or dirt accumulates in the heat dissipation holes, the heat dissipation efficiency of the computer system will be lowered, and the computer system could be damaged or temporarily inactivated.

In order to avoid the above situation, most server systems today have a heat sensing apparatus disposed therein; once the fan breaks or too much foreign matter accumulates in the heat dissipation holes, thus making the heat dissipation air flow insufficient, the temperature of the server will rise above a predetermined standard, so the control unit will increase the rotation speed of the fan to increase the efficiency of heat dissipation. Although this method can indeed prevent overheating of the server, many other reasons can cause a server to overheat, and modern computer systems currently lack a method to accurately determine that the cause of overheating is insufficient air flow.

SUMMARY

The main object of the present invention is to provide a method for detecting heat-dissipating air flow.

Another main object of the present invention is to provide an electronic apparatus for detecting heat-dissipating air flow.

In order to achieve the above objects, the method for detecting heat-dissipating air flow of the present invention is adapted to an electronic apparatus. The electronic apparatus includes a fan and a housing having a plurality of air-in holes, the fan being disposed in the housing for conducting the air outside the housing into the housing and thereby forming a heat-dissipating air flow in the housing. The method comprises the following steps: detecting whether a reset command is input; if the reset command is input, resetting a wind pressure standard value according to the reset command; if the reset command is not input, controlling the fan to operate at full speed according to a start signal; detecting a wind pressure of the heat-dissipating air flow after controlling the fan to operate at full speed to acquire a wind pressure value; determining whether the wind pressure value is equal to the wind pressure standard value; and generating a warning signal if the wind pressure value is not equal to the wind pressure standard value.

The electronic apparatus of the present invention comprises a housing, a fan, a wind pressure sensor and a control unit. The housing includes a plurality of air-in holes. The fan is disposed in the housing for conducting air outside the housing into the housing and thereby forming a heat-dissipating air flow. The wind pressure sensor is disposed in the housing for detecting a wind pressure of the heat-dissipating air flow to acquire a wind pressure value. The control unit is disposed in the housing for receiving a reset command and resetting a wind pressure standard value according to the reset command. In addition, the control unit is able to control the fan to operate at full speed according to a start signal, and to determine whether a wind pressure value measured by the wind pressure sensor is equal to the wind pressure standard value after controlling the fan to operate at full speed, and to generate a warning signal when the wind pressure value is not equal to the wind pressure standard value.

BRIEF DESCRIPTION OF THE DRAWINGS

The exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1:
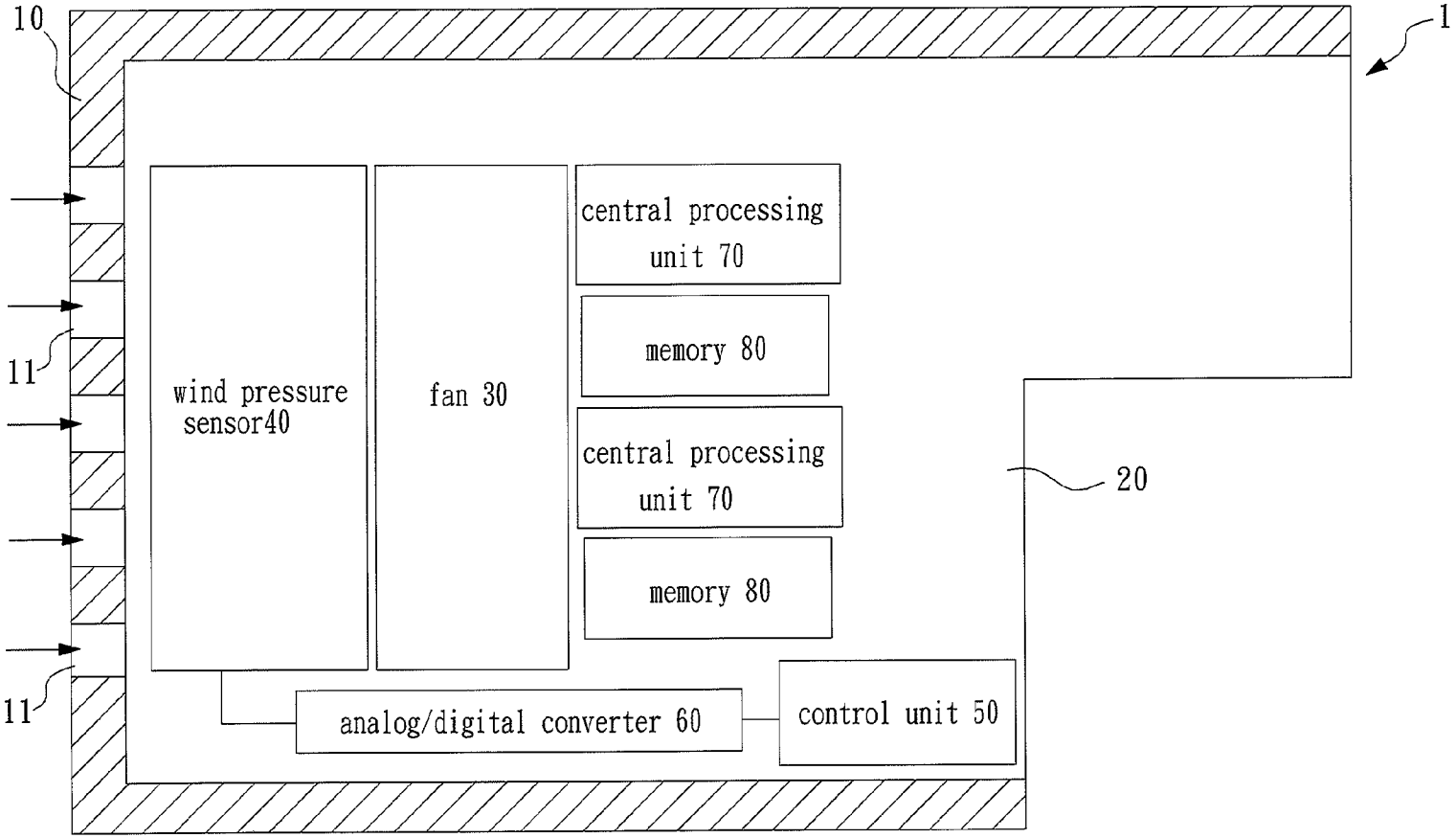
FIG. 1 is a first structural diagram of the electronic apparatus in accordance with an embodiment of the invention.
Figure 2:
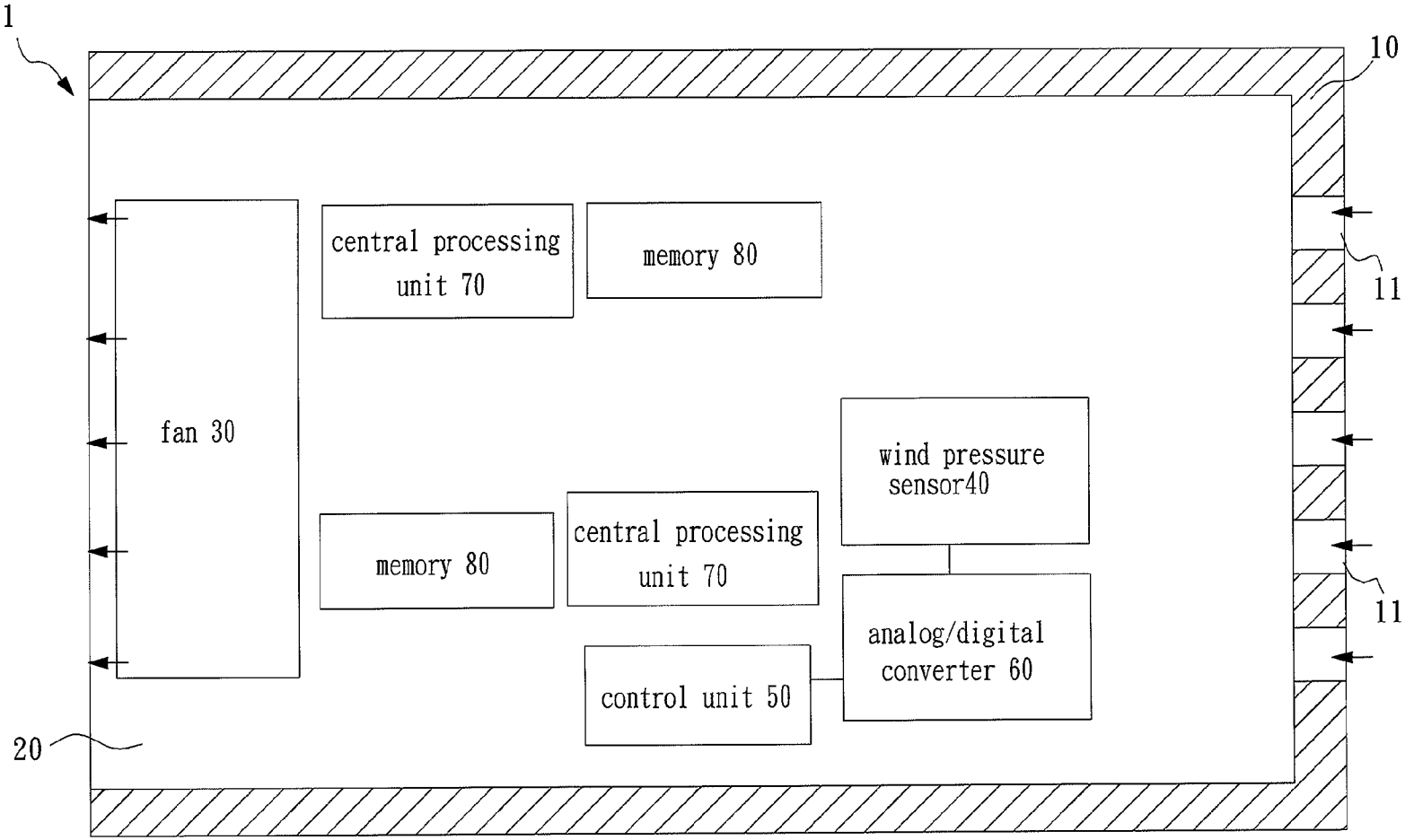
FIG. 2 is a second structural diagram of the electronic apparatus in accordance with an embodiment of the invention.

Please refer to FIG. 1 and FIG. 2, which are structural diagrams of the electronic apparatus in accordance with an embodiment of the invention.

As shown in FIG. 1, this figure illustrates an electronic apparatus 1 having a fan 30 for air cooling. In one embodiment of the present invention, the electronic apparatus 1 comprises a housing 10, a motherboard 20, a fan 30, a wind pressure sensor 40, a control unit 50, an analog/digital converter 60, a plurality of central processing units 70, and a plurality of memories 80. In the specific embodiment of the present invention, the electronic apparatus 1 is a server system, but the present invention is not limited by this example.

In one embodiment of the present invention, the housing 10 has a plurality of air-in holes 11; through the air-in holes 11, the air outside the housing 10 is allowed to enter into the housing 10.

The motherboard 20 is disposed in the housing 10 and is provided for disposing the wind pressure sensor 40, the control unit 50, the analog/digital converter 60, the central processing units 70, and the memories 80 thereon.

The fan 30 is disposed in the housing 10 for conducting the air outside the housing 10 into the housing 10 and thereby forming a heat-dissipating air flow (the arrow shown in FIG.

1) in the housing. The central processing units 70, the memories 80 and other heated devices disposed on the motherboard 20 are cooled by the heat-dissipating air flow.

The wind pressure sensor 40 is embedded on the motherboard 20 in the housing 10 and is located between the air-in hole 11 and the fan 30. The wind pressure sensor 40 is used for detecting a wind pressure of the heat-dissipating air flow to acquire a wind pressure value. In the specific embodiment of the present invention, the wind pressure sensor 40 is a piezoresistive pressure sensor; when the output voltage of the piezoresistive pressure sensor is higher, it indicates that the measured wind pressure is higher, but the present invention is not limited by this example; the wind pressure sensor 40 may also be a current-output type piezoresistive pressure sensor or other type of pressure sensor.

The control unit 50 is also disposed on the motherboard 20 in the housing 10 and is used for receiving a reset command so that a wind pressure standard value can be reset according to the reset command. In addition, the control unit 50 can also control the fan 30 to operate at full speed according to a start signal and can determine whether a wind pressure value measured by the wind pressure sensor 40 is equal to the wind pressure standard value after controlling the fan 30 to operate at full speed. When the wind pressure value is not equal to the wind pressure standard value, the control unit 50 will generate a warning signal. In the embodiment of the present invention, a start signal is generated according to whether a test time arrives, but the present invention is not limited by that embodiment. The start signal also can be manually input in another manner. In the specific embodiment of the present invention, the control unit 50 is a baseboard management controller (BMC), but the present invention is not limited by this example; the control unit 50 could also be a microcontroller, a complex programmable logic device (CPLD), or other programmable type of control chips.

The analog/digital converter 60 is used for converting the wind pressure information measured by the wind pressure sensor 40 from analog signals to digital signals so as to make the pressure information measured by the wind pressure sensor 40 readable by the control unit 50.

Next, FIG. 2 illustrates an electronic apparatus 1 having a fan 30 for air cooling. The difference from the aforementioned electronic apparatus 1 is that the fan 30 is provided for exhausting the heated air inside the housing 10 to the outside of the housing 10; once the air pressure inside the housing 10 is lowered due to the air inside housing 10 being exhausted, the cool air outside the housing 10 will flow through the air-in hole 11 and enter into the housing 10 by the convection effect, and thus a heat-dissipating air flow (the arrow shown in FIG. 2) is formed in the housing 10. The location where the wind pressure sensor 40 is disposed could be the region on the motherboard 20 near the air-in hole 11, and heat-dissipating air flow could be concentrated in this region (related to the device distribution on the motherboard 20); in this way, the wind pressure sensor 40 can detect the maximum wind pressure of the heat-dissipating air flow more accurately.

Figure 3:
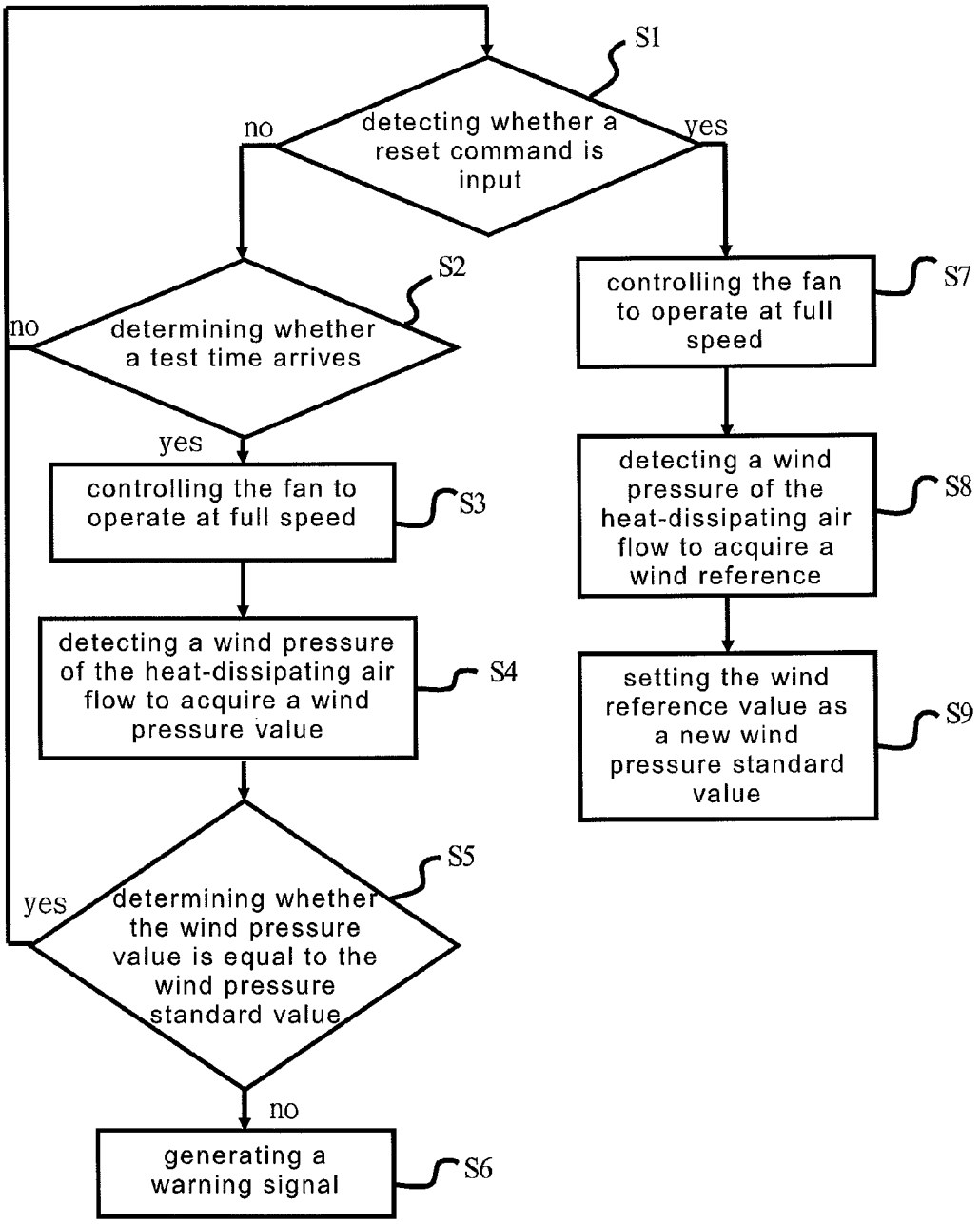
FIG. 3 is a flow chart of the method of detecting heat-dissipating air flow in accordance with an embodiment of the invention.

Finally, please refer to FIG. 3, which presents a flow chart of the method of detecting heat-dissipating air flow in accordance with an embodiment of the invention.

As shown in FIG. 3, this figure indicates the steps of the method for detecting heat-dissipating air flow of the present invention. In the following description, FIG. 1 and FIG. 2 are incorporated to explain the steps of the method for detecting heat-dissipating air flow in accordance with the present invention. It must be noted here that although the aforementioned electronic apparatus 1 is used as an example to explain the method for detecting heat-dissipating air flow of the present invention, the method for detecting heat-dissipating air flow of the present invention is not limited to being applied on the aforementioned electronic apparatus 1.

First, perform step S1: detecting whether a reset command is input.

The method for detecting heat-dissipating air flow of the present invention not only detects whether the air flow amount of the heat-dissipating air flow is sufficient but also provides the manager a function of resetting the wind pressure standard value according to different usage environments or after the state of abnormal air flow amount is eliminated. For example, when the electronic apparatus 1 is used at a high elevation, then due to the thin air at such an elevation, the air flow amount generated at a mountain will be different from the air flow amount generated at level ground even if the fan 30 operates at full speed; thus, it is necessary to reset a new wind pressure standard value so that if the electronic apparatus 1 is used at a high elevation, it will not be determined that the fan 30 or the air-in hole 11 is abnormal (e.g., dirt has accumulated on the air-in hole 11) when the air flow amount measured is lower. For another instance, after the manager clears dirt that has accumulated on the air-in hole 11, the air-in hole 11 should be in the most standard state. Therefore, the manager also could reset the new wind pressure standard value after every clearing. Once the manager presses a reset button (not shown in FIGs) of the electronic apparatus 1, the electronic apparatus 1 will perform a reset mode; in the reset mode, the electronic apparatus 1 resets the wind pressure standard value.

Perform step S2: determining whether a test time arrives.

In one embodiment of the present invention, when the electronic apparatus 1 does not enter into the reset mode, the control unit 50 will start to execute the detection and estimation of the heat-dissipating air flow according to a start signal when the test time arrives. In the specific embodiment, a timer (not shown in the figures) in the control unit 50 is used to measure time and generates a start signal through interrupt processing when the test time arrives, so as to make the control unit 50 start to execute the detection and estimation of the heat-dissipating air flow according to the start signal. For example, the manager can set the test time as 12 o'clock every noon, and every day when the test time arrives, the control unit 50 will perform the following detection and estimation processes automatically. It must be noted here that the automatic start of those processes is used as an example of the way of starting detection in the present invention, but the present invention is not limited to the above examples; the detection could also be started manually by the manager.

Perform step S3: controlling the fan to operate at full speed.

Once the electronic apparatus 1 does not enter the reset mode and the test time arrives, the electronic apparatus 1 will start to detect the heat-dissipating air flow. When the heat-dissipating air flow is being detected, the control unit 50 will control the fan 30 to operate at full speed such that the wind pressure of the heat-dissipating air flow when the fan 30 is operating at full speed can be detected.

Next perform step S4: detecting a wind pressure of the heat-dissipating air flow to acquire a wind pressure value.

When the fan 30 is operating at full speed, the wind pressure sensor 40 detects the wind pressure of the heat-dissipating air flow generated by the fan 30 so as to acquire a wind pressure value, and the wind pressure value is converted by the analog/digital converter 60 from an analog signal to a digital signal, and then the wind pressure value is transmitted to the control unit 50 for estimation.

Perform step S5: determining whether the wind pressure value is equal to the wind pressure standard value.

After the wind pressure sensor 40 transmits the measured wind pressure value to the control unit 50, the control unit 50 will compare the wind pressure value with the stored wind pressure standard value so as to determine whether the measured wind pressure value is equal to the wind pressure standard value.

Perform step S6: generating a warning signal.

If the wind pressure value is not equal to the wind pressure standard value, the control unit 50 will generate a warning signal to the management center to alert the manager. For example, when too much dirt has accumulated in the air-in hole 11, the air flow passing through the air-in hole 11 will be reduced;

thus, when the wind pressure value is smaller than the wind pressure standard value, it is inferred that too much dirt has accumulated in the air-in hole 11, and therefore the manager can be informed by the generated warning signal that it is necessary to clean the air-in hole 11. For another example, if the electronic apparatus 1 is moved to another place having a different air pressure and the user forgets to reset the wind pressure standard value, then during testing, the measured wind pressure will be not equal to the wind pressure standard value even if the air-in hole 11 and the fan 30 are in their normal states. At this time, it may also generate the warning signal so as to inform the manager that it is necessary to reset the wind pressure standard value. On the other hand, when the wind pressure value is equal to the wind pressure standard value, it indicates that the in/out air flow is normal, and the warning signal will be not generated. After the detection is completed, the timer will recount the time, and the electronic apparatus 1 will still detect whether the reset command is input at any time before the test time arrives (i.e. perform step Si), so as to determine whether to enter the reset mode.

Perform step S7: controlling the fan to operate at full speed.

When performing step S1, the control unit 50 detects and receives the reset command entered by the manager, and the electronic apparatus 1 will enter the reset mode and start to reset the wind pressure standard value. When the wind pressure standard value is being reset, first the control unit 50 will control the fan 30 to operate at full speed such that the wind pressure of the heat-dissipating air flow when the fan 30 is operated at full speed can be detected.

Perform step S8: detecting a wind pressure of the heat-dissipating air flow to acquire a wind reference value.

When in the reset mode, after the fan 30 operates at full speed, the wind pressure sensor 40 detects the wind pressure of the heat-dissipating air flow generated by the fan 30 so as to acquire a wind reference value, and the wind reference value is converted by the analog/digital converter 60 from an analog signal to a digital signal, and then the wind reference value is transmitted to the control unit 50.

Perform step S9: setting the wind reference value as a new wind pressure standard value.

Finally, after acquiring the wind reference value, the control unit 50 will set the wind reference value as a new wind pressure standard value for use as the basis of estimation after tests.

It must be noted here that the step sequence of the method for detecting heat-dissipating air flow of the present invention is not limited by the abovementioned example, and that the step sequence above could be changed in order to achieve the object of the present invention.

According to the above description, the method for detecting heat-dissipating air flow of the present invention can determine whether the air-in hole 11 or the fan 30 is in an abnormal state and can inform the manager by generating a warning message. In addition, when the electronic apparatus 1 is moved to another place having a different air pressure for being used, the manager can reset the wind pressure standard value according to different usage environments.

In summary, regardless of the function, the way and result of the present invention have technical characteristics that differ from those of the prior arts, and it is a significant advance in the art. It would be appreciated if the examiners could grant this patent after understanding the content of the present invention so as to benefit society. However, the aforementioned embodiments are just for illustrating the principle and the result of the present invention, and are not for limiting the range of the present invention. It will be obvious to those skilled in the art that, based upon the teachings herein, changes and modifications may be made without departing from this invention and its broader aspects. Therefore, the appended claims are intended to encompass within their scope all such changes and modifications as are within the true spirit and scope of the exemplary embodiment(s) of the present invention.

What is claimed is:

1. A method for detecting heat-dissipating air flow, applied to an electronic apparatus comprising a fan and a housing having a plurality of air-in holes, wherein the fan is disposed in the housing for guiding air outside the housing into the housing, thereby forming a heat-dissipating air flow in the housing, the method comprising the following steps:

detecting whether a reset command is input;

if the reset command is input, resetting a wind pressure standard value according to the reset command;

if the reset command is not input, controlling the fan to operate at full speed according to a start signal;

detecting a wind pressure of the heat-dissipating air flow after controlling the fan to operate at full speed to acquire a wind pressure value;

determining whether the wind pressure value is equal to the wind pressure standard value; and generating a warning signal if the wind pressure value is not equal to the wind pressure standard value.

2. The method as claimed in claim 1, wherein the start signal is generated when a test time arrives; when the wind pressure value is equal to the wind pressure standard value, the method further comprises the following steps:

recounting the test time, and detecting whether the reset command is input before the test time arrives.

3. The method as claimed in claim 1, wherein resetting the wind pressure standard value comprises the following steps:

operating the fan at full speed;

detecting the wind pressure of the heat-dissipating air flow to acquire a wind reference value; and setting the wind pressure reference value as a new wind pressure standard value.

4. An electronic apparatus, comprising:

a housing, comprising a plurality of air-in holes;

a fan, disposed in the housing for guiding air outside the housing into the housing, thereby forming a heat-dissipating air flow;

a wind pressure sensor, disposed in the housing for detecting a wind pressure of the heat-dissipating air flow to acquire a wind pressure value; and a control unit, disposed in the housing for receiving a reset command and for resetting a wind pressure standard value according to the reset command, the control unit being able to control the fan to operate at full speed according to a start signal and to determine whether the wind pressure value measured by the wind pressure sensor is equal to the wind pressure standard value after controlling the fan to operate at full speed, and to generate a warning signal when the wind pressure value is not equal to the wind pressure standard value.

5. The electronic apparatus as claimed in claim 4, wherein the control unit is provided further for setting a test time, and the control unit generates the start signal when the test time arrives.

6. The electronic apparatus as claimed in claim 4, wherein when the control unit resets the wind pressure standard value, the control unit first controls the fan to operate at full speed and then obtains a wind pressure reference value measured by the wind pressure sensor when the fan operates at full speed, thereby setting the wind pressure reference value as a new wind pressure standard value.

7. The electronic apparatus as claimed in claim 4, wherein the wind pressure sensor is a piezoresistive pressure sensor.

8. The electronic apparatus as claimed in claim 4, wherein the control unit is a microcontroller, a complex programmable logic device or a baseboard management controller.

* * * * *